US012686526B2

(12) United States Patent
Berroa García

(10) Patent No.: US 12,686,526 B2
(45) Date of Patent: Jul. 21, 2026

(54) LIGHTENED NECK FOR UPPER PARTS OF LIQUID-CONTAINING CONTAINERS

(71) Applicant: BETAPACK, S.A.U., Irun (ES)

(72) Inventor: Francisco Javier Berroa García, Irun (ES)

(73) Assignee: BETAPACK, S.A.U., Irun (ES)

( * ) Notice: Subject to any disclaimer, the term of this patent is extended or adjusted under 35 U.S.C. 154(b) by 0 days.

(21) Appl. No.: 19/061,664

(22) Filed: Feb. 24, 2025

(65) Prior Publication Data

US 2025/0296721 A1 Sep. 25, 2025

(30) Foreign Application Priority Data

Feb. 23, 2024 (EP) ..... 24382195

(51) Int. Cl.
*B65D 1/02* (2006.01)

(52) U.S. Cl.
CPC ..... *B65D 1/0246* (2013.01); *B65D 1/0207* (2013.01)

(58) Field of Classification Search
CPC .... B65D 1/0246; B65D 1/023; B65D 1/0223; B65D 1/0207; B65D 1/02; B65D 1/46; B65D 11/04; B65D 11/22; B65D 11/26; B65D 2501/0009
USPC ..... 215/45, 44, 43, 42, 40; 220/649, 648, 220/646, 657, 658, 656, 675; 428/35.7
See application file for complete search history.

(56) References Cited

U.S. PATENT DOCUMENTS 4,566,601 A * 1/1986 Kuenzig ..... B65D 41/48 220/675
2023/0303287 A1* 9/2023 Jarman ..... B29C 49/071
2024/0166401 A1* 5/2024 Mejia-Quinchia ... B65D 1/0246

FOREIGN PATENT DOCUMENTS

| | | | |
|---|---|---|---|
| CA | 3163966 | A1 | 8/2021 |
| DE | 202023105564 | U1 | 11/2023 |
| EP | 2648983 | A1 | 10/2013 |
| EP | 3608248 | A1 | 2/2020 |
| EP | 4039613 | A1 | 8/2022 |
| ES | 1295646 | U | 11/2022 |
| WO | WO2012076664 | A1 | 6/2012 |
| WO | WO2020216968 | A1 | 10/2020 |

OTHER PUBLICATIONS

Extended European Search Report dated Aug. 22, 2024 for European Application No. 24382195.6.

* cited by examiner

*Primary Examiner* — Robert J Hicks

(57) ABSTRACT

Lightened neck for upper parts of liquid-containing containers consists of a tubular body axially attachable to the upper part (1) of a container, a tubular body that has a lower sector and an upper sector and comprising the following consecutive parts, described from the lower sector towards the upper sector: a lower collar (3) intended to be coupled and in intimate contact with the upper part (1); a support ring (4) with a height (h4) from 2 mm to 3.7 mm; a cylindrical part (5) with a height (h5) from 22.6 mm to 24 mm; and an upper washer (6), intended to receive a closing cap (2) and which in turn comprises, consecutively, a lower ring (7), a straight portion (8) and an upper ring (9).

2 Claims, 4 Drawing Sheets

LIGHTENED NECK FOR UPPER PARTS OF LIQUID-CONTAINING CONTAINERS

OBJECT OF THE INVENTION

The present invention falls within the technical field of liquid-containing containers, and refers in particular to a lightened neck attachable to the upper part of a liquid-containing container. It is especially designed for the case of light plastic containers, and includes elements that allow a pressure coupling of a top closure cap, to give rise to what are known as SNAP type necks.

BACKGROUND OF THE INVENTION

In the current state of the art, various liquid-containing containers are known, specially designed to allow direct consumption of the product contained through the pouring hole, without the need to pour it into a container. Within these containers, those specially configured to contain high-density semi-liquid fluids such as liquid yogurts or smoothies are known.

An example of this type of container can be found in the European patent with publication number EP3608248, which refers to a container for food or food products or containers in the shape of cups or jars, where said food products contained therein can be i) liquid, for example a drink or milk or dairy products, ii) semi-liquid, for example yogurt or cream or fruit smoothies, iii) solid, in the form of chips, granules or powder, for example fruits, cereals or chocolate. Food or food products may be loose or already packaged in jars.

In the packaging industry there is a need to obtain lightweight, functional and reliable products, using the minimum possible amount of materials. This is due first of all to economic needs, both in manufacturing, transportation and storage, as well as current trends in reducing plastic consumption. Within the different types of packaging, much attention has been paid to elements such as bottles, packaging or boxes, and there have been achieved products that are lightweight and function correctly.

However, in the case of closure elements, such as closure caps for liquid containers, such efforts are not so common. A lightened neck, attachable to the upper part of a pre-existing lightweight container, contributes to increasing its stability, reducing both the total weight and the amount of plastic necessary for its manufacture and, consequently, the total costs.

The utility model with publication number ES1295646, owned by this same applicant, describes a neck for upper parts of liquid-containing containers made up of a tubular body axially attachable to the upper part of a container and which is intended to receive, at its upper end, a closing cap. The cap allows the opening and closing of a liquid pouring hole delimited by the neck, and therefore by the neck once attached to the neck.

Said neck however has some disadvantages. For example, when the first opening of a cap attached to the neck occurs, this is not clearly evident since the necessary fall of the lower ring does not occur as it is retained and fitted into the distribution ring of the neck.

There is therefore a need to have a lightened neck attachable to the upper part of a liquid-containing container overcoming the current objections of the state of the art.

DESCRIPTION OF THE INVENTION

The object of the invention consists of a lightened neck attachable to the upper part of a liquid-containing container, where the upper part is finished with a pouring hole that allows the liquid to escape from the interior of the container. The neck includes elements for retaining the neck in the upper part and elements for coupling a cap for opening and closing the pouring hole.

The neck is made from a tubular body made of a light plastic material such as polyethylene terephthalate (PET) or high-density polyethylene (HDPE).

The tubular body comprises the following consecutive parts, described from a lower sector to an upper sector: a lower support collar, a support flange, a cylindrical part and an upper washer.

The lower collar is intended to be engaged and in intimate contact with the upper part. The support ring is a support or distribution ring that is used for fastening in the distribution and blowing lines during processing. The cylindrical part acts as a transition between the support ring and the upper washer and represents the part of the neck with the smaller diametric dimensions. Finally, the upper washer is intended to receive the closing cap.

In the lightened neck of the invention, the distance between the lower collar and the support ring has been considerably reduced. The main objective of the modification is to have a clear indication of the first opening of a cap. As indicated above, in current necks the lower ring cannot fall because it is always in contact with the distribution ring.

By modifying the preform to reduce the aforementioned distance, what is achieved is that there is more distance and it can be clearly seen if there has been an opening since a clearance is generated between the lower ring of the cap and the lower collar of the neck of at least 0.36 mm.

DESCRIPTION OF THE DRAWINGS

To complement the description that is being made and in order to help a better understanding of the characteristics of the invention, in accordance with a preferred example of practical embodiment thereof, a set of drawings is attached as an integral part of said description, where, for illustrative and non-limiting purposes, the following has been represented.

PREFERRED EMBODIMENT OF THE INVENTION

Below, with the help of the aforementioned figures, a detailed explanation of an example of a preferred embodiment of the object of the present invention is provided.

Figure 1:
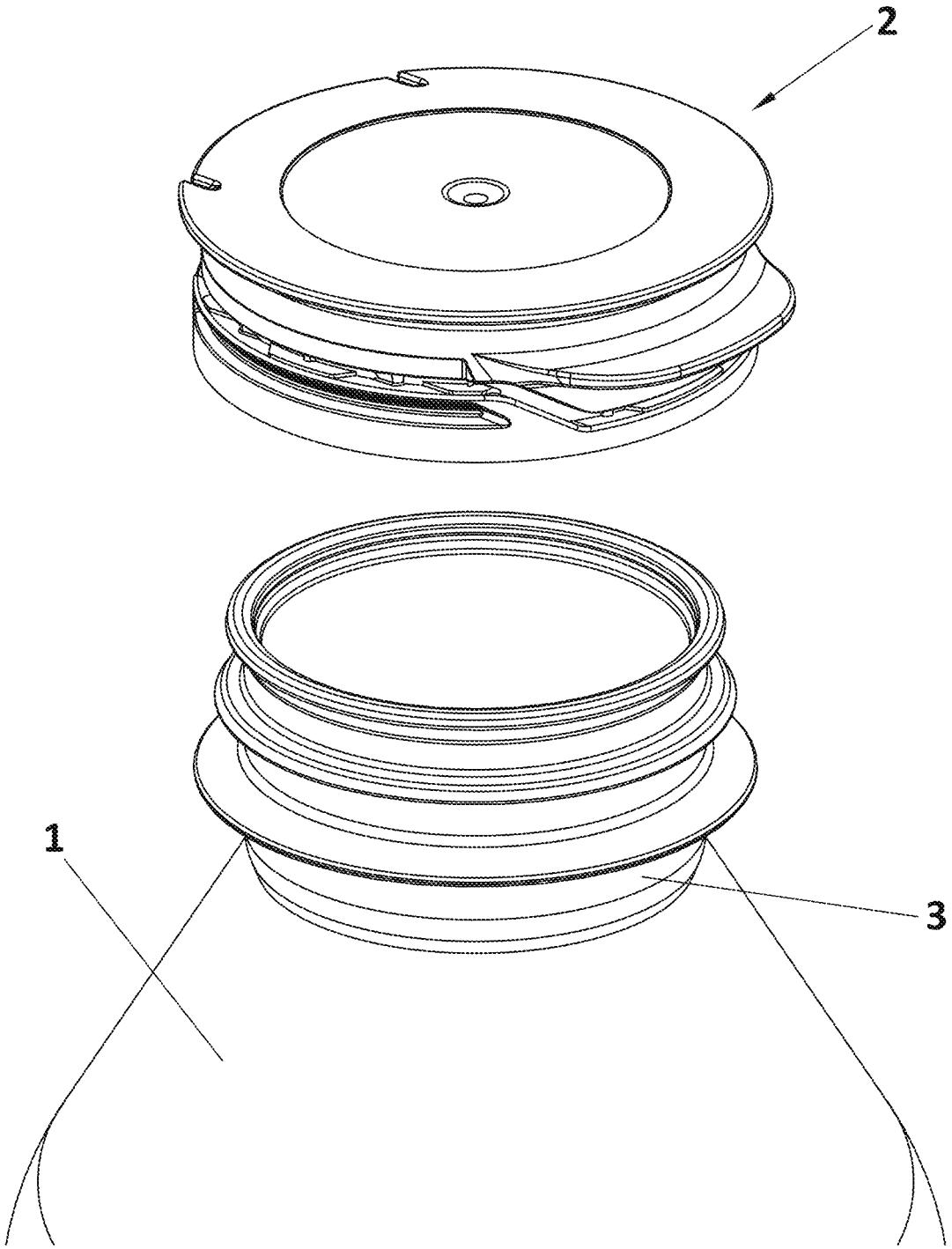
FIG. 1.—Shows a perspective view of the lightened neck, inserted into the upper part of a container and prior to attaching a cap.
Figure 2:
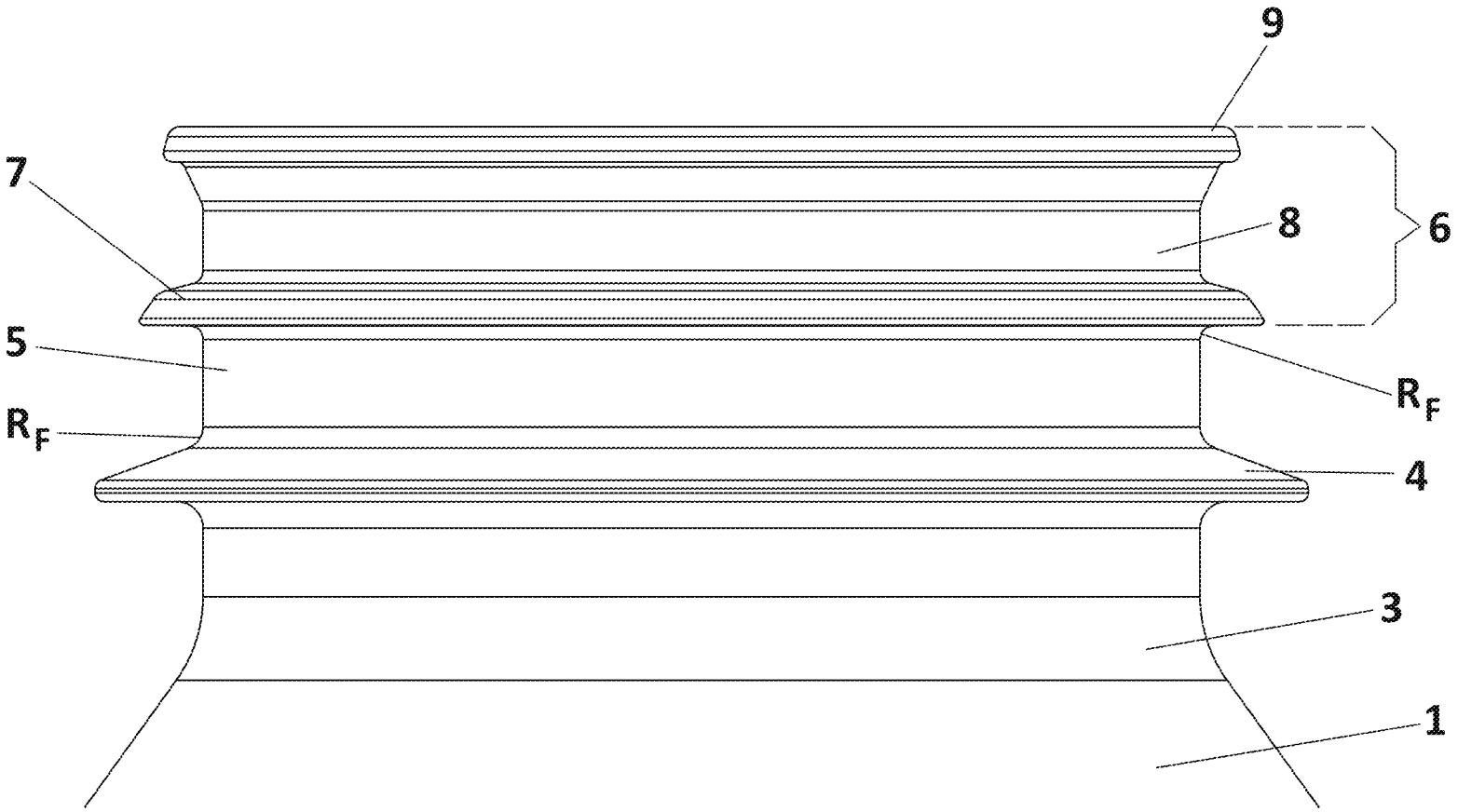
FIG. 2.—Shows a front view of the neck inserted in the upper part of a container.

The lightened neck for upper parts of liquid-containing containers described, shown in FIGS. 1 and 2, is made up of a tubular body axially attachable to the upper part (1) of a container and which is intended to receive, at its upper end, a closing cap (2). The cap (2) allows the opening and closing of a liquid pouring hole delimited by the upper part (1), and therefore by the neck once attached to the upper part (1).

The tubular body has a lower sector and an upper sector. The lower sector is intended to be in intimate contact with an initial part of the neck, while the upper sector is intended to be aligned with the pouring hole at the upper end of the neck.

The tubular body comprises the following consecutive parts, described from the lower sector to the upper sector: a lower support collar (3), a support ring (4), a cylindrical part (5) and an upper washer (6).

The lower collar (3) is intended to be coupled and in intimate contact with the upper part (1). The support ring (4) is a support or distribution ring that is used to hold the distribution and blowing lines during neck manufacturing. The cylindrical part (5) has fusion radii (Rf) with the support ring (4) and with the upper washer (6). The upper washer (6) is intended to receive the cap (2), and in turn comprises, consecutively, a lower ring (7), a straight portion (8) and an upper ring (9).

Figure 3:
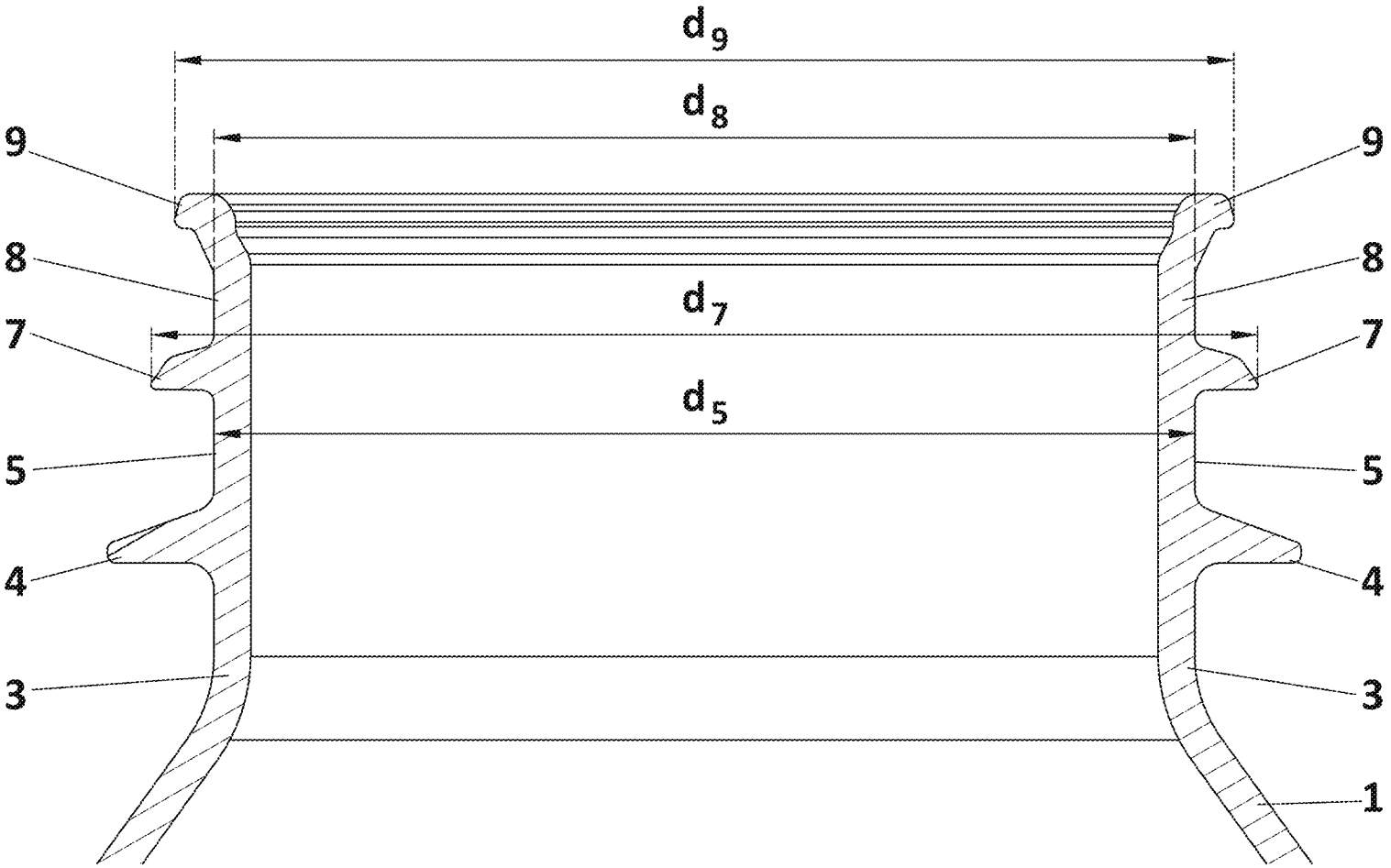
FIG. 3.—Shows a front view of a longitudinal section made in the neck inserted in the upper part of a container.
Figure 4:
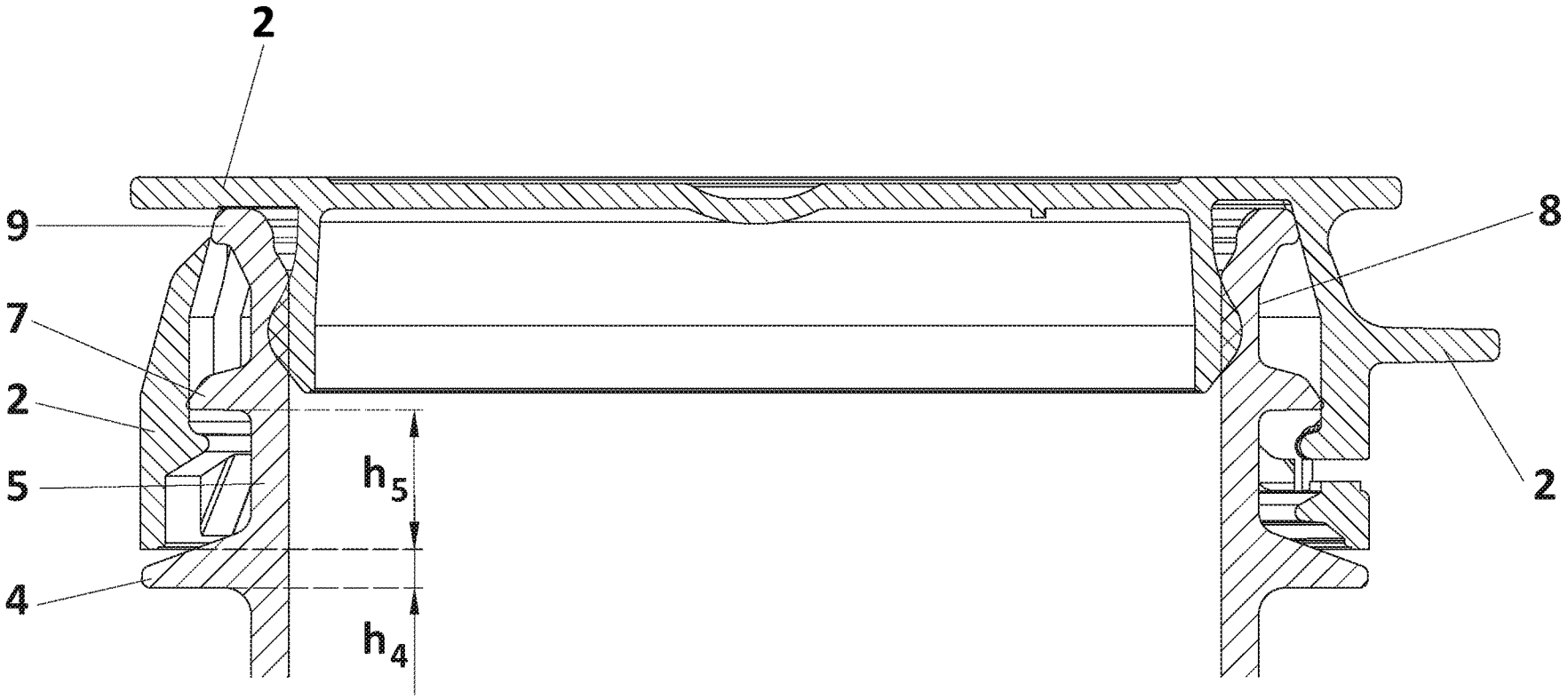
FIG. 4.—Shows a front view of a longitudinal section made in the neck inserted in the upper part of a container and with the cap attached, where dimensions and diameters are indicated.

FIGS. 3 and 4 detail the dimensions and diameters mentioned below.

The support ring (4) has an external height (h4) measured between an upper end of the collar (3) and a lower end of the cylindrical part (5) with a value, in millimeters, within a range ranging from 0.5 mm up to 2 mm.

The cylindrical part (5) has a height (h5) measured between the support ring (4) and the lower ring (7). The height (h5) has a value within a range that goes from 2 mm to 3.7 mm, including the upper and lower extreme values of said range. Said cylindrical part (5) also has an internal diameter (d5) ranging from 22.6 mm to 24 mm.

The lower ring (7) has a total diameter (d7) within a range that goes from 25.35 mm to 25.65 mm, including the upper and lower extreme values of said range. The straight portion (8) has a total diameter (d8) ranging from 22.6 mm to 24 mm. Finally, the upper ring (9) has a total diameter (d9) within a range from 24.25 mm to 24.55 mm.

The invention claimed is:

1. Lightened neck for upper parts of liquid-containing containers, consisting of a tubular body axially attachable to the upper part (1) of a container, wherein the tubular body has a lower sector and an upper sector and comprises the following consecutive parts, described from the lower sector to the upper sector:

a lower collar (3) intended to be coupled and in intimate contact with the upper part (1);

a support ring (4);

a cylindrical part (5); and an upper washer (6), intended to receive a closing cap (2) and which in turn comprises, consecutively, a lower ring (7), a straight portion (8) and an upper ring (9); the lightened neck being characterized in that:

the support ring (4) has an external height (h4) measured between an upper end of the collar (3) and a lower end of the cylindrical part (5) with a value within a range from 0.5 mm to 2 mm;

the cylindrical part (5) has a height (h5) measured between the support ring (4) and the lower ring (7) with a value within a range from 2 mm to 3.7 mm, including the upper and lower extreme values of said range;

the cylindrical part (5) has an internal diameter (d5) ranging from 22.6 mm to 24 mm;

the lower ring (7) has a total diameter (d7) within a range that goes from 25.35 mm to 25.65 mm, including the upper and lower extreme values of said range;

the straight portion (8) has a total diameter (d8) within a range from 22.6 mm to 24 mm; and the upper ring (9) has a total diameter (d9) within a range from 24.25 mm to 24.55 mm.

2. Lightened neck for upper parts according to claim 1, wherein the tubular body is made of polyethylene terephthalate (PET) or high-density polyethylene (HDPE).

* * * * *